US006938773B1

(12) United States Patent
Sotto

(10) Patent No.: US 6,938,773 B1
(45) Date of Patent: Sep. 6, 2005

(54) UNIVERSAL COMPUTER PACKAGING CUSHION

(75) Inventor: Ryan Sotto, Escondido, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 10/851,301

(22) Filed: May 21, 2004

Related U.S. Application Data

(60) Provisional application No. 60/544,634, filed on Feb. 13, 2004.

(51) Int. Cl.[7] ..... B65D 81/02
(52) U.S. Cl. ..... 206/523; 206/592; 206/588
(58) Field of Search ..... 206/320, 453, 206/523, 586, 592, 594, 588

(56) References Cited

U.S. PATENT DOCUMENTS

| | | | | |
|---|---|---|---|---|
| 3,695,421 A | | 10/1972 | Wood | 206/46 FC |
| 4,122,946 A | * | 10/1978 | Holley | 206/523 |
| 4,602,715 A | | 7/1986 | Sarver et al. | 206/523 |
| 4,840,277 A | | 6/1989 | Waldner | 206/523 |
| 4,892,193 A | | 1/1990 | Thomas | 206/453 |
| 4,972,954 A | * | 11/1990 | Dickie | 206/523 |
| 5,010,988 A | | 4/1991 | Brown | 190/104 |
| 5,207,327 A | | 5/1993 | Brondos | 206/523 |
| 5,484,063 A | | 1/1996 | Cuccio et al. | 206/722 |
| 5,573,114 A | | 11/1996 | Cyr | 206/316.1 |
| 5,738,216 A | | 4/1998 | Warner | 206/523 |
| 5,857,568 A | | 1/1999 | Speirs | 206/320 |
| 5,996,749 A | | 12/1999 | Hillsberg et al. | 190/109 |
| 6,179,122 B1 | | 1/2001 | Moncrief et al. | 206/320 |
| 6,223,896 B1 | | 5/2001 | Bell et al. | 206/320 |
| 6,305,539 B1 | | 10/2001 | Sanders, Jr. | 206/320 |
| 6,499,599 B1 | * | 12/2002 | Hopkins et al. | 206/523 |
| 6,597,568 B2 | | 7/2003 | Ryder | 361/683 |
| 6,622,860 B2 | | 9/2003 | Horbal | 206/320 |
| 6,695,140 B2 | | 2/2004 | Manuel | 206/320 |
| 2002/0066683 A1 | | 6/2002 | Sanders, Jr. | 206/320 |

* cited by examiner

*Primary Examiner*—David T. Fidei
(74) *Attorney, Agent, or Firm*—John L. Rogitz

(57) ABSTRACT

A computer cushion has a foam frame defining a window through which a computer can be placed to rest on supports that are glued to the frame and that span the window. Hinged flaps are provided on the inside of each side of the frame, and the flaps are biased against the frame inside the window to reduce its size for smaller computers. When a larger computer is pushed through the window, it can pivot one or more of the flaps outwardly from the window so the computer will fit into the now-larger window.

10 Claims, 2 Drawing Sheets

UNIVERSAL COMPUTER PACKAGING CUSHION

RELATED APPLICATIONS

This application claims priority from U.S. provisional application Ser. No. 60/544,634, filed Feb. 13, 2004.

FIELD OF THE INVENTION

The present invention relates generally to shipping containers for computer systems.

BACKGROUND OF THE INVENTION

A computer production area is normally filled with palates of products, packaging cushions for he products, and shipping cartons. A computer can be shipped to a consumer with many accessories. For example, some computer peripherals include a mouse, a battery charger, a power cord, and a keyboard. These peripherals are not connected to the computer but are still shipped with the computer and generally require separate packaging.

As understood herein, a computer production area can require a great deal of space for manufacturing, testing, and shipping the computer. Also, space is required for loading software onto computers prior to shipment to a consumer. Unfortunately, valuable space is consumed by the shipping materials, which can decrease production throughput. The present invention recognizes that one source of this problem is the fact that different sizes of computers require different sizes of packaging cushions to snugly hold the computers within the shipping boxes, so that a plethora of differently-sized cushions must be stored in the production area, consuming excessive space. Having made this critical observation, the invention herein has been provided.

SUMMARY OF THE INVENTION

A computer packaging cushion for holding a computer component includes a parallelepiped-shaped frame that defines a window which is substantially in the center of the frame. At least one U-shaped support is engaged with the frame and spans the window. Also, one or more flaps are hingedly engaged with the frame and are biased to a first configuration, wherein the flaps are substantially flush against respective inner walls of the frame to partially block the window. The flaps are movable to a second configuration, wherein the flaps are folded outwardly away from the window.

In one embodiment four flaps are provided, one for each side of the frame. Each flap may be attached to the frame by a hinge that can be defined by a lamination material. A flap can be moved to the second configuration automatically when a computer component is pushed against the flap while advancing the component through the window. The frame may be made of foam.

In another aspect, a cushion for packaging includes at least one support in which a component can be cushionably supported, and at least one frame engaged with the support and defining a window structure through which the component can be disposed to rest on the support. The window structure is biased to a first configuration in which the window structure defines a relatively smaller window area. Also, the window structure is movable to a second configuration when a sufficiently large object is advanced therethrough to define a relatively larger window area.

In still another aspect, a method of making a packaging cushion includes providing lamination on a foam structure, and cutting the foam structure to form a window centrally therein without cutting completely through all of the lamination. With this method, sufficient lamination remains to establish a hinge between a frame defined during the cutting act and at least one flap that is also defined during the cutting act.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a perspective view of the computer packaging cushion, with the upper and lower flaps folded out and the side flaps folded in;

DETAILED DESCRIPTION OF THE PREFERRED EMBODIMENT

Figure 1:
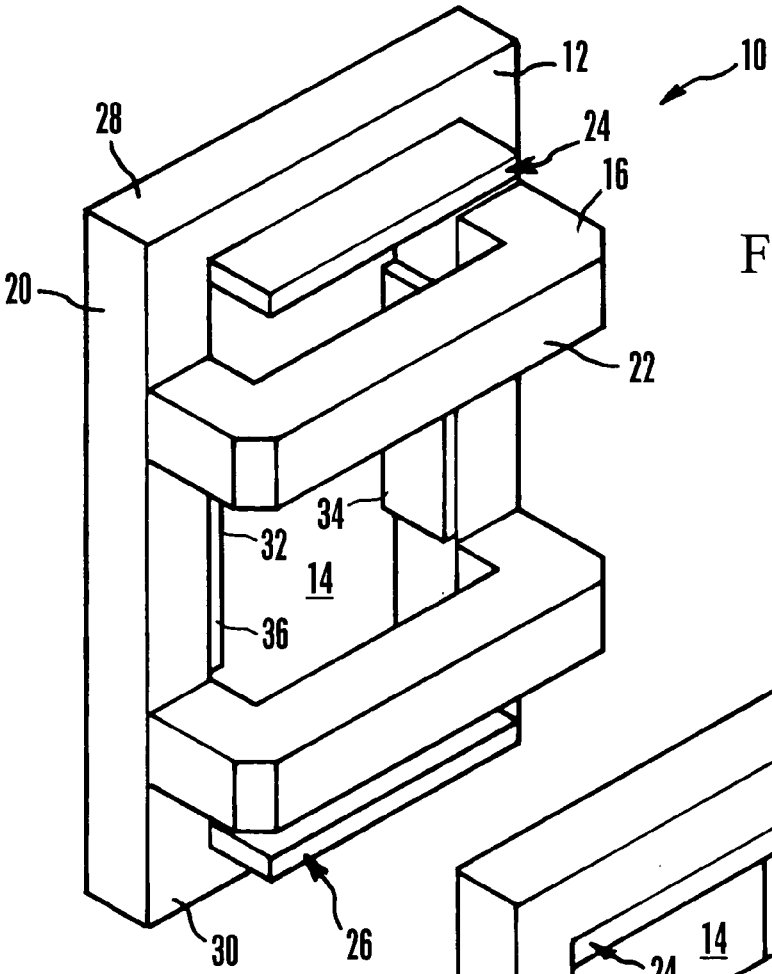
Figure 2:
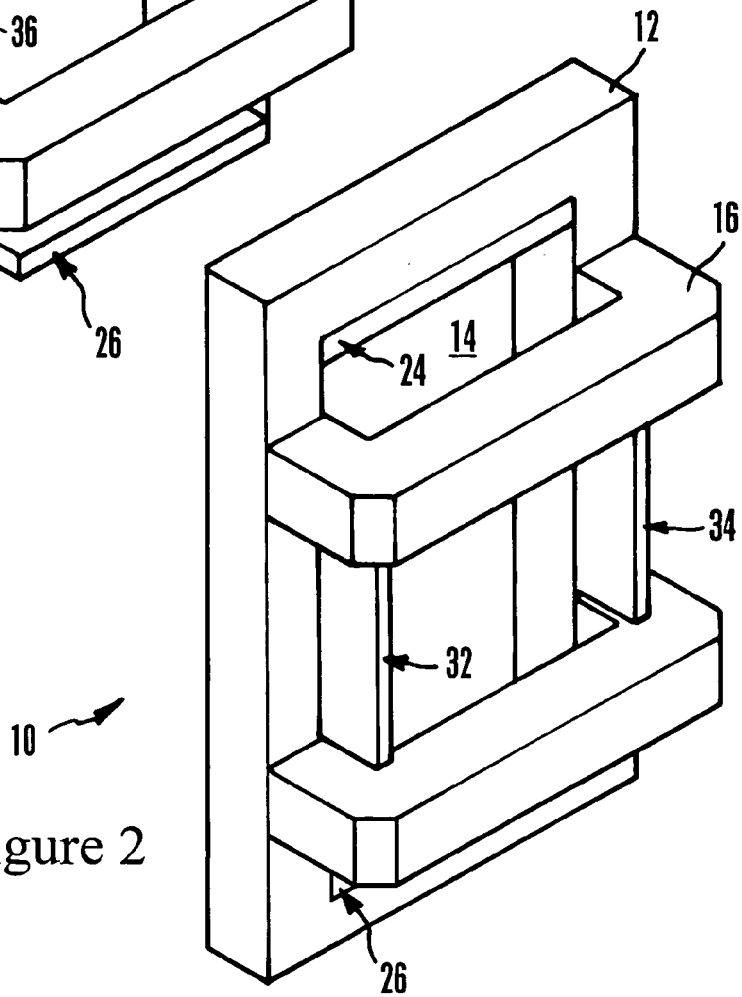
FIG. 2 is a perspective view of the computer packaging cushion, with the upper and lower flaps folded in and the side flaps folded out.
Figure 3:
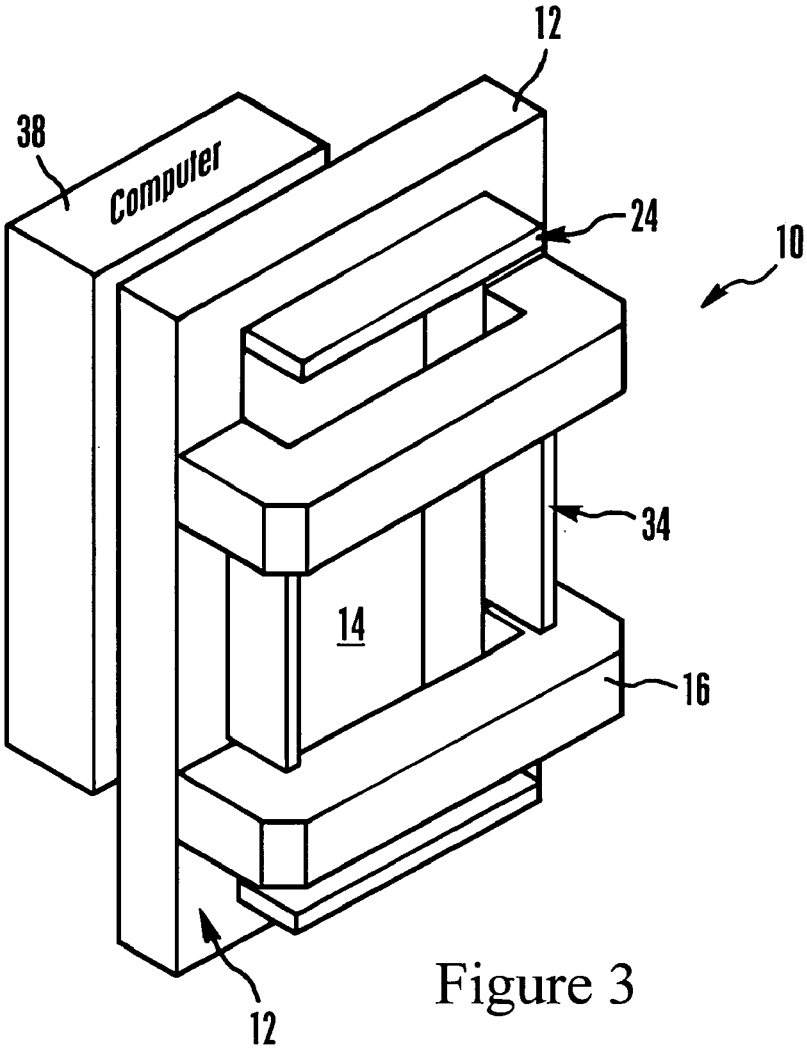
FIG. 3 is a perspective view of the computer packaging cushion, with all four flaps folded out, showing a computer component in an exploded relationship with the cushion.

Referring initially to FIGS. 1–3, a packaging cushion is shown, generally designated 10, for holding, in a box, a computer component (such as a personal computer shown in FIG. 3 below). In accordance with present principles, the packaging cushion 10 may include a hollow parallelepiped-shaped unitary foam frame 12 defining a central rectangular window 14.

For illustration purposes terms of orientation (such as "upper", "lower", "left", "right", etc.) will be used in the discussion below, it being understood that the terms of orientation are relative only and non-limiting. For instance, the "upper" part of the packaging cushion 10 may actually be placed against what might be termed a "bottom" of a box, etc.

As shown in FIGS. 1–3, at least one and preferably two U-shaped supports 16 are connected to the frame 12 by, e.g., solvent bonding. Specifically, each support 16 is connected to the front surfaces 18 of opposite parallel left and right sides 20 of the frame 12 such that a cross-bar 22 of each support 16 spans the window 14.

In accordance with the present invention, the cushion 10 includes at least one and preferably four flaps that are hingedly coupled to the frame. In the embodiment shown, the cushion 10 includes upper and lower flaps 24, 26 that are respectively hinged to upper and lower segments 28, 30 of the frame 12. Also, the cushion 10 includes left and right flaps 32, 34 that are respectively hinged to the left and right sides 20 of the frame 12. In one non-limiting embodiment, a lamination material 36 establishes the hinge between each flap and its respective frame side. In one embodiment, the frame 12 may be made of conventional packaging foam and the lamination material is made of thicker and stronger foam material than the frame 12. In the non-limiting embodiment shown in FIG. 1, the upper and lower flaps 24, 26 may be long enough to extend substantially the entire width of the window 14, whereas if desired the side flaps 32, 34 may be only so long as to extend only part of the way of the length of the window 14 as shown, although the side flaps 32, 34 may alternatively extend for substantially the entire length of the window 14.

Owing to the hinge structure described above, the flaps 24, 26, 32, 34 are materially biased by the respective hinges 36 to a recessed configuration, wherein the flap is substantially flush against the inner wall of its respective side of the frame 12. In FIG. 1, the side flaps 32, 34 are shown in the recessed configuration, and in FIG. 2 the upper and lower flaps 24, 26 are shown in the recessed configuration. Also, each flap 24, 26, 32, 34 can be moved to an extended configuration, wherein the flap is folded outwardly away from the window 14 such that the face of the flap that is against the inner wall of the frame when the flap in the recessed configuration is substantially coplanar with and adjacent to the inner wall when in the extended configuration. In FIG. 1, the upper and lower flaps 24, 26 are shown in the extended configuration, while in FIG. 2 the side flaps 32, 34 are in the extended configuration. In FIG. 3, all four flaps are in the extended configuration. It readily will be appreciated that a flap in the recessed configuration partially blocks the window 14, and when a flap is in the extended configuration it does not block the window. In addition to the particular combinations of flap configurations shown in FIGS. 1–3, all four flaps may be recessed, or only one flap extended, or some other combination, may be possible with the cushion 10.

Referring specifically to FIG. 3, because the flaps are hinged to the frame, when a component such as a computer 38 is pushed against a flap while advancing the component through the window 14, the flap being pushed pivots from the recessed configuration to the extended configuration automatically. The flap is held in the extended configuration by the component, which extends through the window 14 to rest on the supports 16. Then, when the component is removed from the cushion 10, any flap in the extended configuration pivots back to the recessed configuration, owing to the material bias provided by the non-limiting hinge. The frame 12 accordingly can be thought of as having a window structure through which the component 38 can be disposed to rest on the supports 16, with the window structure being biased to a recessed configuration in which the window structure defines a relatively smaller window area and with the window structure being movable to an extended configuration when a sufficiently large object is advanced therethrough to define a relatively larger window area.

With this structure, it may now be appreciated that the frame 12 with flaps 24, 26, 32, 34 can be configured and sized such that a computer or other component with a relatively smaller form factor will fit snugly within window 14 when all four flaps are in the recessed configuration. It may be further appreciated that a component with a relatively larger form factor can be pushed through the window 14 to pivot one or more of the flaps 24, 26, 32, 34 as necessary to provide clearance for the component to rest partially within the window 14 and partially against the supports 16, again snugly held on all four sides by the frame 12 with flaps.

Figure 4:
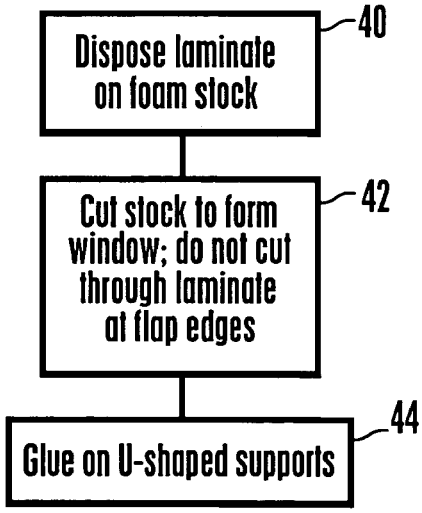
FIG. 4 is a flow chart of the method for making the cushion.

Now referring to FIG. 4, a non-limiting method for making the cushion 10 can be seen. A blank piece of foam stock is provided at block 40 and a laminate material disposed on it by means known in the art. The foam stock may be a solid parallelepiped-shaped piece of material. Then, at block 42 the stock is cut (e.g., by stamping) to form the window 14. During the cutting process, the portions of the laminate that are to form the hinges 36 are not cut. Also during the cutting process, the flaps 24, 26, 32, 34 are formed by cutting away foam material around them to shape them into, e.g., parallelepiped-shaped flaps as shown. At block 44 the U-shaped supports can be glued onto the frame 12.

While the particular UNIVERSAL COMPUTER PACKAGING CUSHION as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". It is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. Absent express definitions herein, claim terms are to be given all ordinary and accustomed meanings that are not irreconcilable with the present specification and file history.

What is claimed is:

1. A computer packaging cushion for holding at least one computer component, comprising:

a parallelepiped-shaped frame defining a window substantially in the center thereof;

at least one U-shaped support engaged with the frame and spanning the window; and at least one flap hingedly engaged with the frame and biased to a first configuration, wherein the flap is substantially flush against an inner wall of the frame to partially block the window, the flap being movable to a second configuration, wherein the flap is folded outwardly away from the window, wherein four flaps are provided, one for each side of the frame.

2. The cushion of claim 1, wherein the flap is attached to the frame by a hinge, the hinge being defined by a lamination material.

3. The cushion of claim 1, wherein the flap is moved to the second configuration automatically when a computer component is pushed against the flap while advancing the component through the window.

4. The cushion of claim 1, comprising two supports spanning the window.

5. The cushion of claim 1, wherein the frame is made of foam.

6. A cushion for packaging, comprising:

at least one support in which a component can be cushionably supported; and at least one frame engaged with the support and defining a window structure through which the component can be disposed to rest on the support, wherein the window structure is biased to a first configuration in which the window structure defines a relatively smaller window area, the window structure being movable to a second configuration when a sufficiently large object is advanced therethrough to define a relatively larger window area, wherein the frame defines a window and the window structure includes four flaps hingedly engaged with respective sides of the frame, each flap being biased to a recessed configuration, wherein the flap is substantially flush against an inner wall of the frame, each flap being movable to an extended configuration, wherein the flap is folded outwardly away from the window.

7. The cushion of claim 6, wherein the flap is attached to the frame by a hinge, the hinge being defined by a lamination material.

8. The cushion of claim 6, wherein the flap is moved to the second configuration automatically when a computer component is pushed against the flap while advancing the component through the window.

9. The cushion of claim 6, comprising two supports spanning the window.

10. The cushion of claim 6, wherein the frame is made of foam.

* * * * *